United States Patent [19]

Cvek

[11] Patent Number: 4,858,807

[45] Date of Patent: Aug. 22, 1989

[54] TRACE CUTTER FOR ROLL MATERIAL

[76] Inventor: Sava Cvek, 142 Pearl St., Cambridge, Mass. 02139

[21] Appl. No.: 888,708

[22] Filed: Jul. 22, 1986

[51] Int. Cl.[4] ..... B65D 85/672

[52] U.S. Cl. ..... 225/58; 225/65; 225/91

[58] Field of Search ..... 225/65, 66, 58, 61, 225/47, 91

[56] References Cited

U.S. PATENT DOCUMENTS

| | | | |
|---|---|---|---|
| 963,001 | 6/1910 | Dibrell | 225/91 X |
| 2,732,145 | 1/1956 | Serrone | 225/61 |
| 3,070,273 | 12/1962 | Warp | 225/58 |
| 3,679,110 | 7/1972 | Stine | 225/47 |
| 4,252,258 | 2/1981 | Plummer, III | 225/91 X |
| 4,358,328 | 11/1982 | Pearson | 225/65 X |
| 4,445,645 | 5/1984 | Byer | 225/47 X |

FOREIGN PATENT DOCUMENTS

| | | | |
|---|---|---|---|
| 921186 | 4/1947 | France | 225/58 |
| 511216 | 8/1939 | United Kingdom | 225/66 |

*Primary Examiner*—Frank T. Yost

[57] ABSTRACT

A device for cutting sheet material wound in a cylindrical roll includes a blade member having a cutting edge extending the length thereof, and positioning means extending from the roll of sheet material to the blade member for positioning the blade parallel to the axis of the roll. The positioning means includes a portion thereof distal with respect to the blade in rolling engagement with a surface of the roll to align the roll axis and the cutting edge. In one embodiment, an arm extends from each end of the blade to the roll and a pin protrudes from the arm inside the roll to bear against the inner surface thereof. A bearing, which may be bushing of a diameter substantially less than an inner diameter of the roll, rotates on the pin so that the blade is pendulously suspended from the inner surface of the roll. Graduations are provide on one or both sides of the blade member, and methods are disclosed for using the blade member as a drafting instrument to measure, and to draw horizontal and vertical lines.

21 Claims, 8 Drawing Sheets

TRACE CUTTER FOR ROLL MATERIAL

BACKGROUND

The present invention relates to methods and devices for cutting paper such as draftsman's tracing paper, supplied in rolls. To use such tracing paper, a draftsman places the roll on a table over the drawing, unrolls sufficient paper to cover the portions of the drawing to be copied, and traces the drawing. The completed tracing is cut from the roll, either by using scissors, or by placing a rule over the paper and tearing the tracing off along a straight edge. This manner of cutting may be awkward, and generally results in tracings of irregular size, with irregular or non-square edges.

For dispensing other types of paper, for example wrapping paper, it is known to provide a frame on a stationary stand for holding the roll of Paper, and a separate blade element attached to the frame and moveable to bear down against the roll of paper so that the paper may be torn off in a straight line against the blade. Such devices are shown in U.S. Pat. No. 1,380,729 issued June 7, 1921 for an invention of B. Miller, and also U.S. Pat. No. 1,398,711 issued November 29, 1921 for an invention of F. J. Bofsky. Another paper cutting device specifically for wrapping paper is shown in U.S. Pat. No. 3,132,784 issued May 12, 1964 for an invention of B. Cohen et al. The device of that patent is a frame for supporting three rolls of gift wrapping paper. A taut cord or wire (14 of FIGS. 1 –4), held by the frame, provides a straight edge against which the paper is torn off. Another paper dispenser having some elements in common with the foregoing is shown in U.S. Pat. No. 3,915,364, issued October 28, 1975 to L. E. Dieguez, for a dispenser for rolled paper, such as adding machine paper, from a drawer or wall mount. That dispenser has a roll holder, and also has a pair of metal plates forming a guide channel with a cutting blade at the top. Other roll material dispensers and cutters are shown in U.S. Pat. 4,275,827 issued June 30, 1981 for an invention of B. R. Cole, and U.S. Pat. 3,260,431 issued July 12, 1966 for an invention of J. T. Ference.

Because tracing paper may be used to trace odd details at irregular positions and orientations over a drawing, the roll of tracing paper is moved to irregular positions on the paper; thus the frame structures of known dispenser/cutter devices are inappropriate for this application.

OBJECTS AND SUMMARY OF THE INVENTION

It is an object of the invention to provide an improved cutter for roll material such as tracing paper.

It is another object of the invention to provide a trace paper cutter with measuring or drafting capabilities.

It is a further object of the invention to provide an improved trace paper cutter adaptable to rolls of tracing paper of different widths.

These and other features of the invention are provided in a device for cutting sheet roll material from a body of such material wound about a cylindrical shell roller, in which the device includes a cutting blade as long as the roller with a cutting edge orientated away from the roller, and a positioning structure, extending from each end of the blade and in rolling contact with the roll of material in such a way as to maintain the blade parallel axis of the roll. In a preferred embodiment the blade is positioned by first and second parallel arms which are mounted for hanging from respective first and second ends of the roll by freely bearing against an inner surface of the roller. In a further preferred embodiment, each arm includes a pin extending into the roll, and a bearing, mounted on the pin for bearing against the inner surface of the roll. In yet a further preferred embodiment, the bearing is of a diameter substantially less than the inner diameter of the roll. In other embodiments, the positioning means may be a cylindrical casing of a diameter greater than the roll material, and having an opening for passage of material therethrough. The roll of material fits within the casing, and the blade is secured to the casing, extending outwardly therefrom. In yet another embodiment, a pair of end caps having central holes therethrough are secured in opposing ends of the roll, and the blade is mounted to the roller by a pair of wire arms. One end of each arm is affixed to the blade, and the opposing end has a right angle bend passing into the central hole of the end cap of the roller so as to serve as an axle therefor.

BRIEF DESCRIPTION OF THE DRAWINGS

These and other features of the invention will be understood with reference to the drawings, in which.

DETAILED DESCRIPTION

Figure 1:
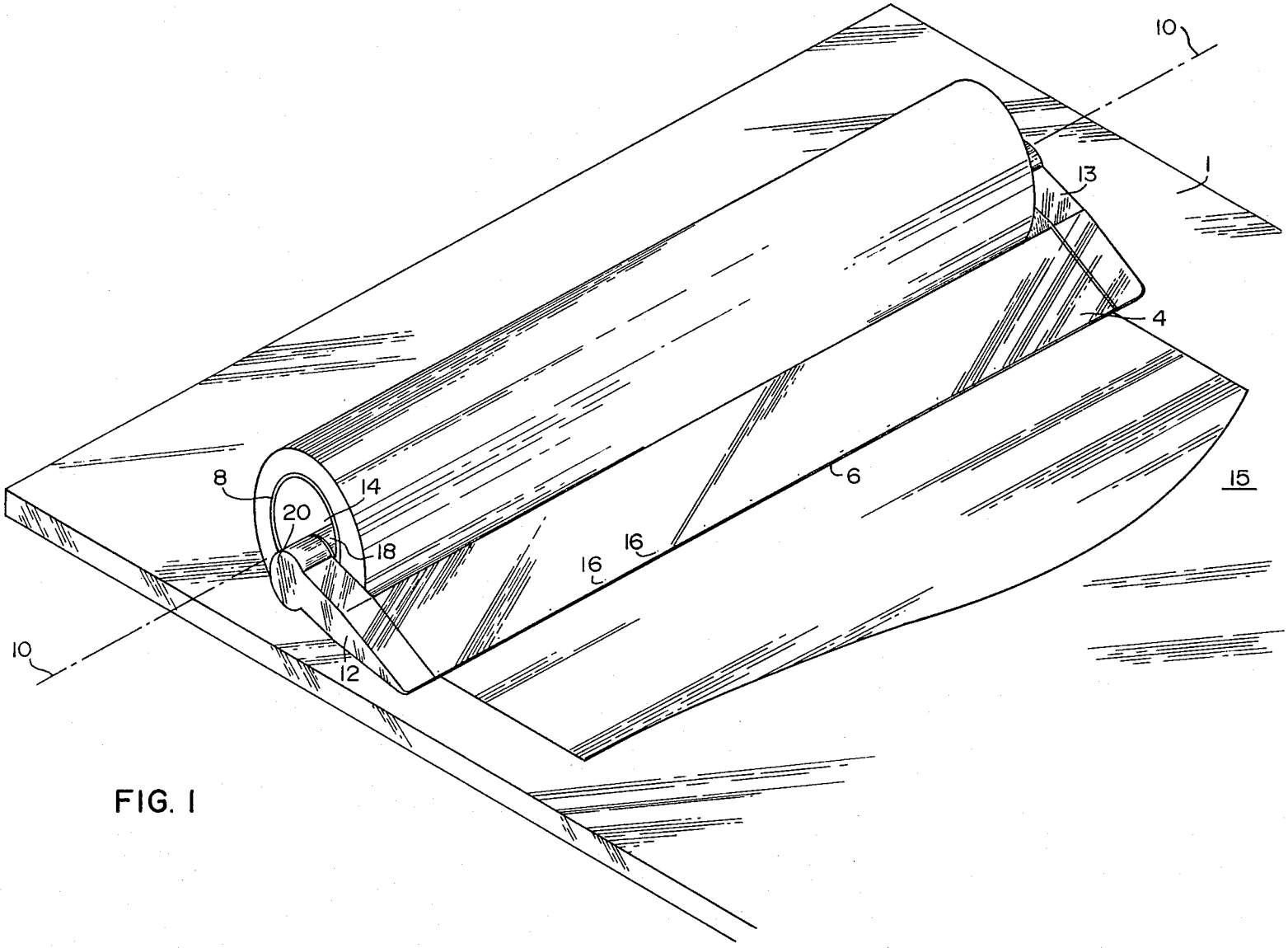
FIG. 1 shows a perspective view of a trace cutter according to the invention.

FIG. 1 shows a perspective view of a device 1 according to the invention for cutting rolled sheet material 2, such as tracing paper, from a roll. The material 2 is rolled on an open-ended cylindrical shell 8 made of rigid material such as cardboard or plastic, and may have a length, for example, of 12 inches, 18 inches, 24 inches or more. The roll has a central axis 10 shown for purposes of illustration. The roll of material is shown resting on a table top 15 in an irregular orientation.

Device 1 includes a blade member 4 having a cutting edge 6 oriented away from the roll of material. Adjacent to edge 6 are graduations 16. Preferably, the blade member has a central plane of symmetry so that the whole device may be flipped over to either side of the roll. In such an embodiment both the upper and lower faces of the blade member have graduations thereon. For example metric graduations may be on one side, and English graduations on the other. Blade member 4 has a pair of arms 12, 13 extending from opposing ends thereof to the roll for positioning, the blade with respect thereto. Each arm has a positioning structure 14 at the end opposite to the blade member, for positioning the arm by pivoting or freely rolling within the cylindrical shell 8. This structure 14 is shown as a roller bushing 18 which turns about a central pin 20. When the roll is resting on the table, the arms 12, 13 will move under the influence of gravity to position the blade parallel to the roll axis 10.

The device 1 is used as follows. When it is determined what length of tracing paper is to be cut, the roll is unrolled to that length, by rolling along the table so that the blade 4 rests on the table parallel to the roll axis. The draftsman then bears down on the blade with one hand while ripping up on the paper with the other hand. This produces a clean, straight cut along the cutting edge of the blade member. In addition, blade member 4 may be used with its graduations 16 as a measuring rule. Further, the cutting edge 6 is maintained perpendicular to the sheet, hence may be used as a vertical bar for drawing perpendicular lines. Finally, by holding a pen or lead against the cutting edge 6 and rolling the roll so as to pendulously drag along member 4, straight horizontal lines may be drawn at desired height locations indicated by the graduations 16 on the rule. Alternatively, a triangle may be placed against the cutting edge to provide a horizontal drafting edge. Thus, the illustrated device is a tracing paper cutter which also serves as a drafting instrument to draw horizontal and vertical lines in desired locations without external frames or similar structures.

Figure 2B:
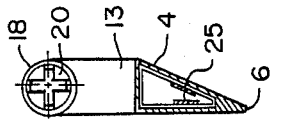
FIGS. 2A–2D show views of one embodiment of the invention, with variations.
Figure 2A:
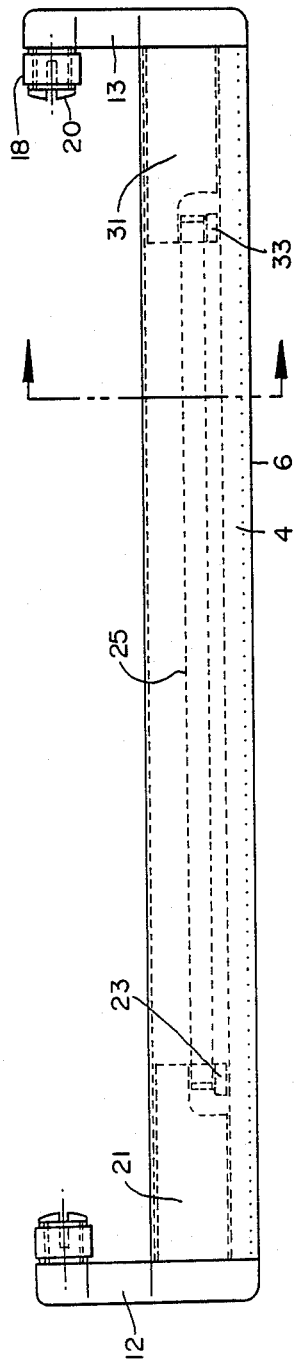

FIGS. 2A–2D show views of a trace cutter according to one embodiment the invention. Corresponding components in these drawings are numbered identically to the identical components of FIG. 1. As shown in FIG. 2A, the device includes two end pieces 12, 13 and a blade member 4. End piece 12 has an L-shaped extension 21 (shown in phantom) which fits within a hollow channel of blade member 4. A hook 23 of member 21 engages an elastic connector 25, such as a rubber band. The opposing end piece 13 has a corresponding extension 31 and hook 33. Either end member 12, 13 may be pulled out in order to fit the device onto a roll. Furthermore, blade members 4 of different lengths may be provided to accommodate rolls of differing length, and end pieces 12, 13 may be interchangeably used with any blade.

FIG. 2B shows a side view of the arm 12 by way of example. Shown in phantom are pin 20 and roller 18 on the opposing side of the arms. Arm 12 has a profile tapering to a point, and corresponding to the cross-sectional shape of the blade member 4.

Figure 2C:
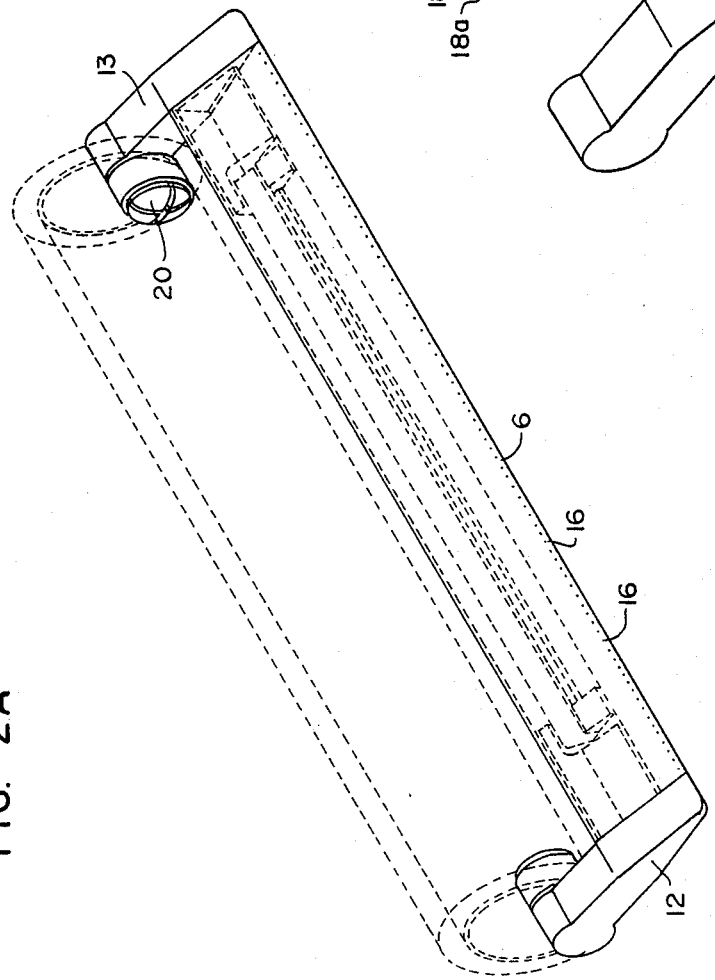

FIG. 2C shows a perspective view corresponding to FIG. 1 of a device similar to that of FIGS. 2A–2B, with a roll of material drawn in phantom. Arms 12, 13 differ from that of FIG. 2B in having a symmetrically tapered profile, discussed below in relation to FIG. 3, and pin **20*a* differs from the integrally-formed pin 20** of FIGS. 2A, 2B. In other respects the embodiment of FIG. 2C is identical.

Figure 2D:
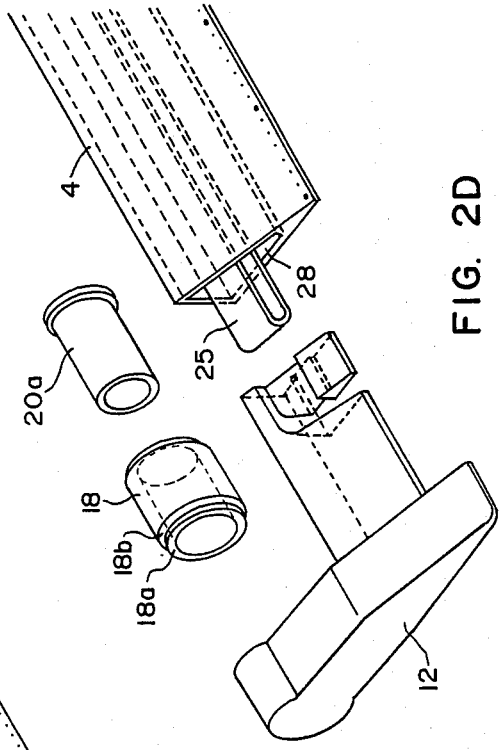

FIG. 2D shows a partial exploded view of the end piece or arm of the device of FIG. 2C. Arm 12 fits within an opening 28 in blade member 4, which is preferably formed as an extruded member. Pin **20*a* fits through bushing 18 and snap-fits into arm 12. Bushing 18 comprises a hard inner sleeve 18*a* and a frictional polymer outer cover 18*b***.

Figure 3B:
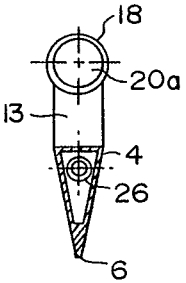
FIGS. 3A, 3B show views of another embodiment of the invention.
Figure 3A:
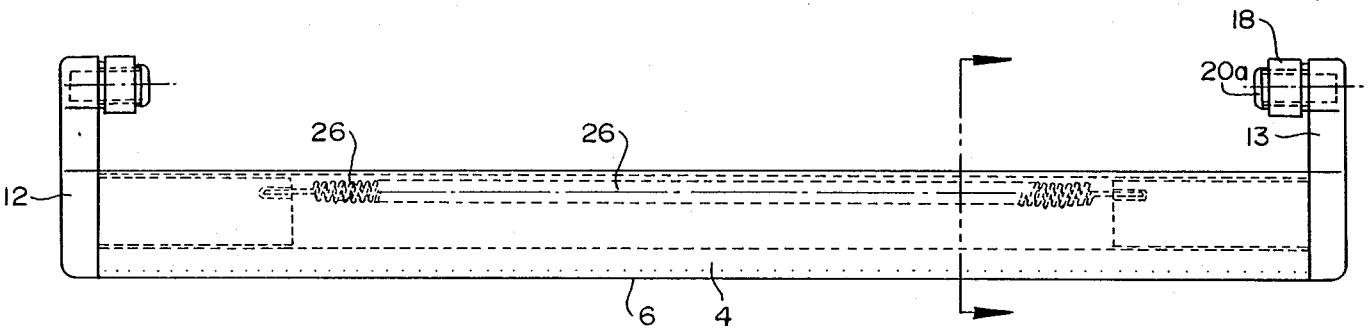

FIGS. 3A, 3B show another embodiment of the invention in which a spring 26 interconnects the pair of arms. The embodiment shown in FIGS. 3A, 3B further differs from that of FIGS. 2A,B in having a blade member which tapers symmetrically to the cutting edge, and which may be flipped over and used on the opposing side of the roll. In addition, arms 12, 13 may be identical pieces. Another advantage of such taper is discussed in connection with FIGS. 6A, 6B, below.

FIG. 3B shows an end view of the device, in which it may be seen that the right hand portion of arm 12, which serves as an end cap for the blade, has the aforesaid symmetric triangular profile. This preferred profile for the blade member and the end portions of the arms, allows the arms 12, 13 to be interchanged with each other, and further allows the entire blade assembly 4, to be flipped over to the opposing side of the roller while still permitting the cutting edge 6, to maintain proper contact with the work table. Preferably, cutting edge 6 has a radiused edge, so that as the amount of material on the roll decreases, the cutting member always presents the same pointed aspect as its line of contact with the tracing paper.

Figure 4B:
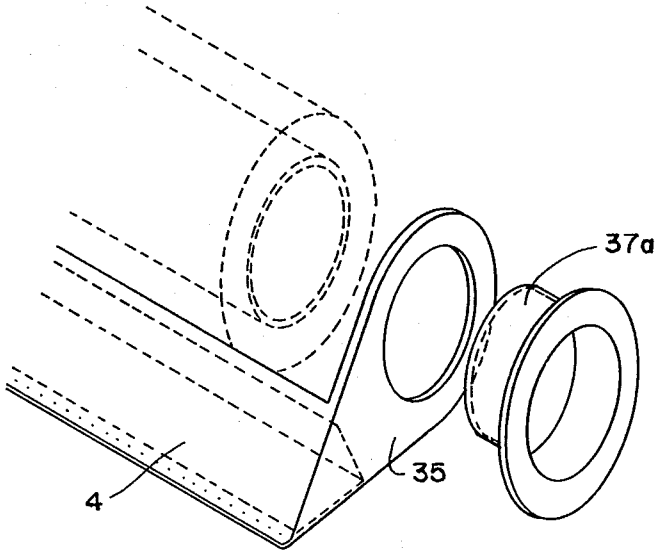
FIGS. 4A, 4B, 4C partial perspective show views of alternative embodiments of the invention.
Figure 4C:
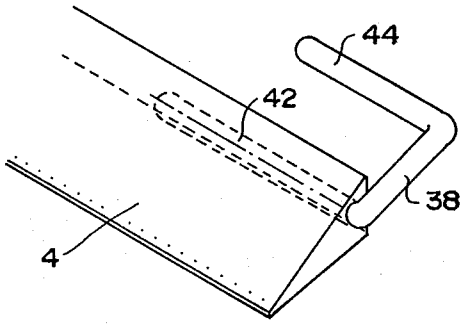
Figure 4A:
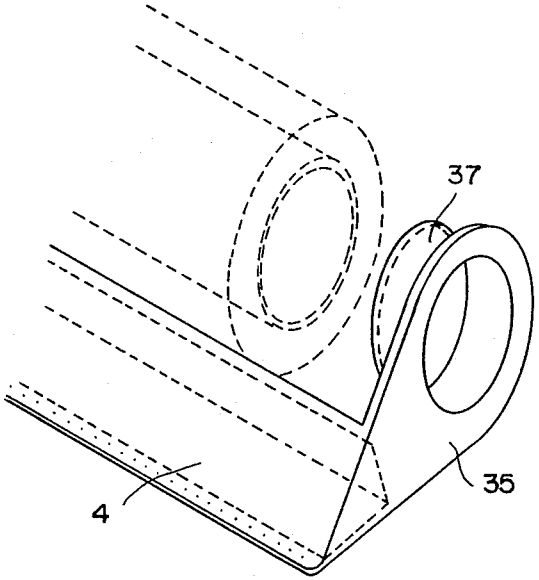

FIG. 4A shows an end detail of a alternate construction of a trace cutter according to the invention. In this embodiment, a blade 4 is integrally molded with a pair of arm members 35, each having a centering bushing 37 in the form of a cup-like protrusion.

FIG. 4B shows an end detail of another variation in which the centering bushing **37*a* is a separate cylindrical insert which is pressed into arm 35** with a snap fit.

FIG. 4C shows an end detail of yet another variation in which a U-shaped bar 38 interconnects the blade member 4 with the roller. Bar 38 has a first arm 42 which presses into a hole in the blade and is secured by a snap fit or detent, and a second arm 44 which fits within the interior of the roller shell for suspending the blade therefrom. The structure may be used as shown, or alternatively, a roller bushing may be Provided on arm 44, similar to element 18 of FIG. 1, or a centering bushing such as is used in a paint roller may be provided, so that arm 44 aligns the blade parallel to the central axis of the roller.

Figure 5B:
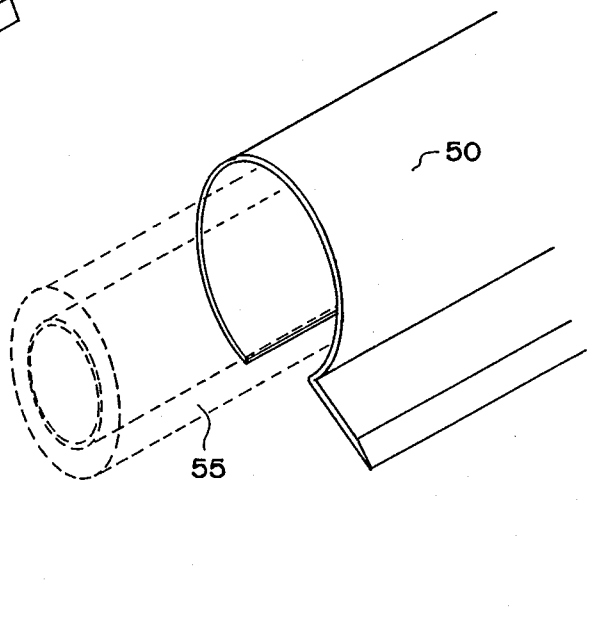
FIGS. 5A, 5B show perspective views of another embodiment of the invention.
Figure 5A:
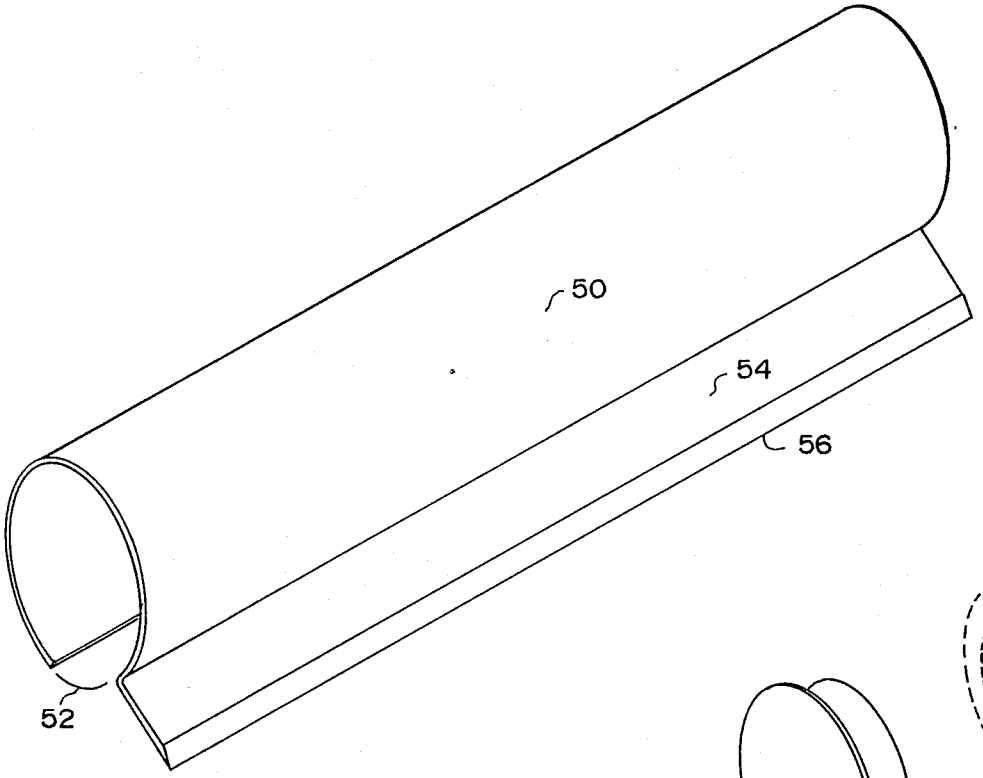

FIGS. 5A, 5B show perspective views of another embodiment of the invention. A casing 50 has an attached blade 54 with a cutting edge 56. Casing 50 is a generally cylindrical casing having an opening 52 along the length thereof. As shown in the exploded view, FIG. 5B, a roll of material 55 fits within the casing 50, and a cap 58 fits into the casing end to secure the roll therein. Sheet material passes through opening 52 and is cut off along cutting edge 56. The roll 55 turns freely within casing 50, which bears against the outer surface of the roll material to always maintain the cutting edge 56 aligned with the central axis of the roll.

Figure 6B:
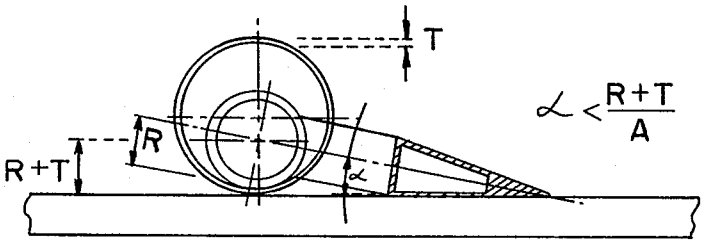
FIGS. 6A, 6B show end views of a representative embodiment affixed to a roll of material.
Figure 6A:
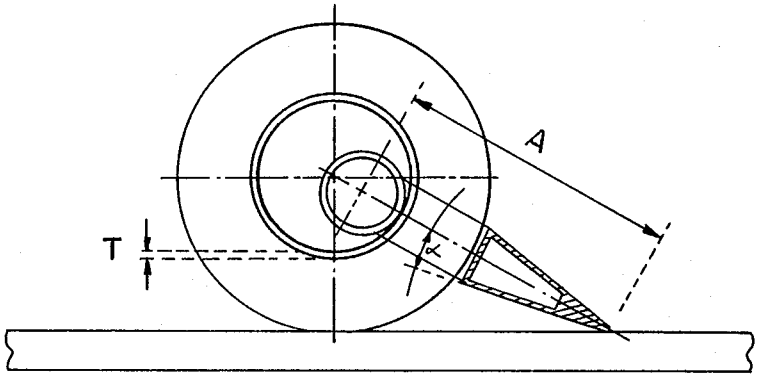

FIGS. 6A, 6B show end views of a trace cutter and roll of tracing paper according to the invention as shown for instance in FIGS. 1 to 3, with a full roll of tracing paper (FIG. 6A), and with an near-empty roll of tracing paper (FIG. 6B). In this embodiment, the arm has a roller bushing (18 of FIG. 1) having a radius R, and the cylindrical shell (8 of FIG. 1) has a thickness T, so that even when the roll is empty, the arm holds the blade member about an axis located R +T above the table. The arm holds the cutting edge of the blade a distance A from that axis. As shown, the preferred embodiment of the blade member is symmetric about a plane running from the axis of the roller bushings centrally through the blade member to the cutting edge, and the arm member converges symmetrically to the cutting edge from above and below that plane at an angle alpha ($\alpha$) with respect to the central plane. As shown in FIG. 6B angle alpha is less than $$\frac{R+T}{A}.$$

Thus, for example where bushing 18 is of small diameter, e.g., approximately 1 centimeter, and the thickness T of the shell is small, e.g., on the order of several millimeters, the device may still accommodate a roll of paper several inches in diameter while maintaining good cutter to table top contact with full, part-full or near-empty rolls. This configuration makes the graduated face of the cutting member lie nearly horizontally, at a small acute angle with respect to the paper and tabletop, which enhances its use as a ruler or scale.

FIGS. 7A–7E show construction and attachment of the positioning member and blade according to different embodiments of the invention.

Figure 7B:
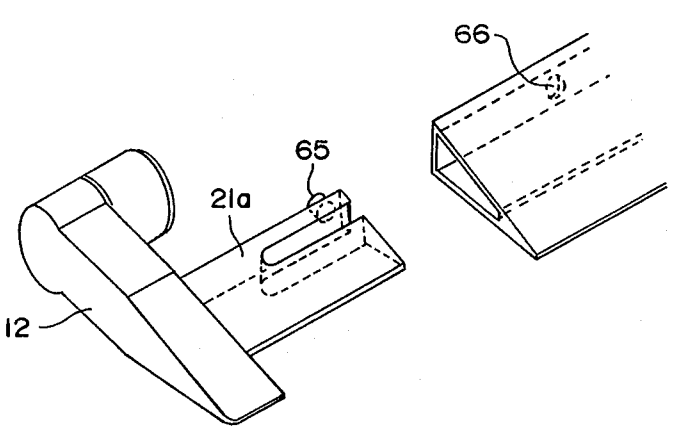
FIGS. 7A–7E show details of other embodiments.
Figure 7C:
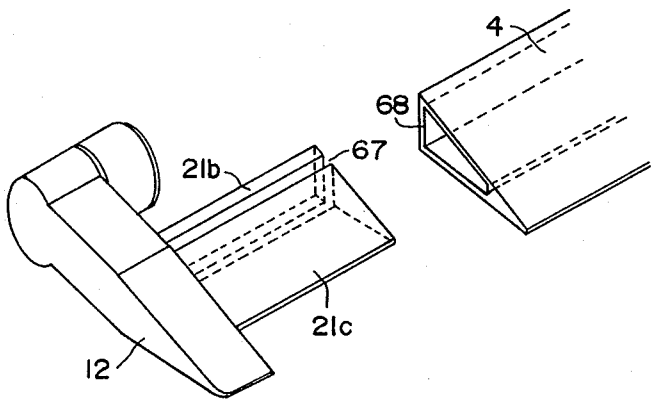
Figure 7A:
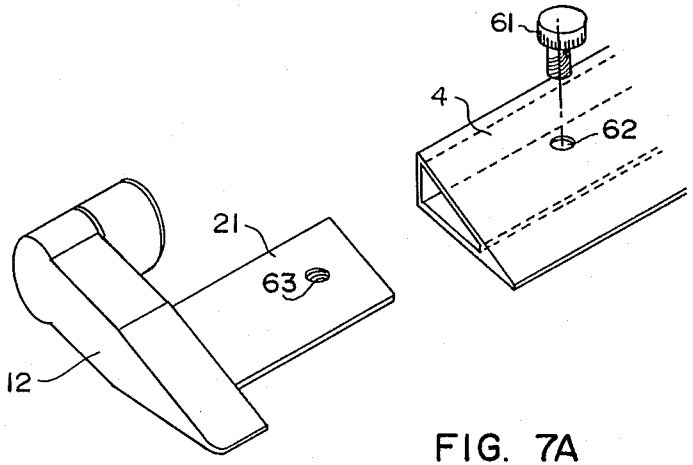

FIG. 7A shows an embodiment similar to that of FIG. 2C, but lacking the spring-loaded arm. Instead, arm 12 has an extension 21 with a threaded hole 63 therein. A knurled mounting bolt 61 fits through a corresponding hole 62 in blade member 4 to removably secure the arm to the blade, so as to permit attachment of the cutter device to a roll of material.

FIG. 7B shows an embodiment having a slotted extension 21*a*. A bump 65 protrudes from a flex-bendable portion of extension 21*a* and locks the arm to the blade by projecting, when assembled, into a mating aperture 66 in the blade member.

FIG. 7C shows a related embodiment, in which a slot 67 is defined between adjacent extension portions 21*b*, 21*c* . Slot 67 is slightly thinner than the rear wall 68 of blade 4, so that the extension tightly grips the rear wall 68 when portion 21*c* is pressed into the blade hollow.

Figure 7D:
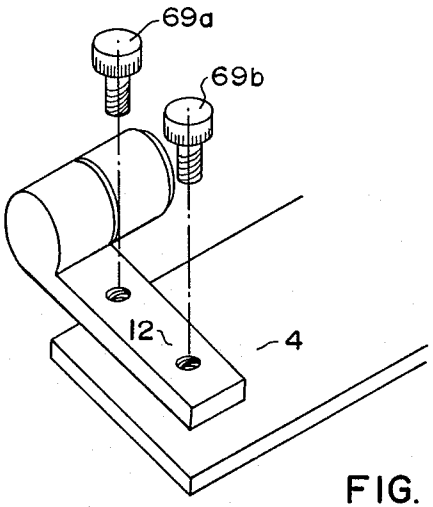

FIG. 7D shows an embodiment in which an arm 12 is removably secured to a blade 4 with a pair of thumbscrews 69*a*, , 69*b*.

Figure 7E:
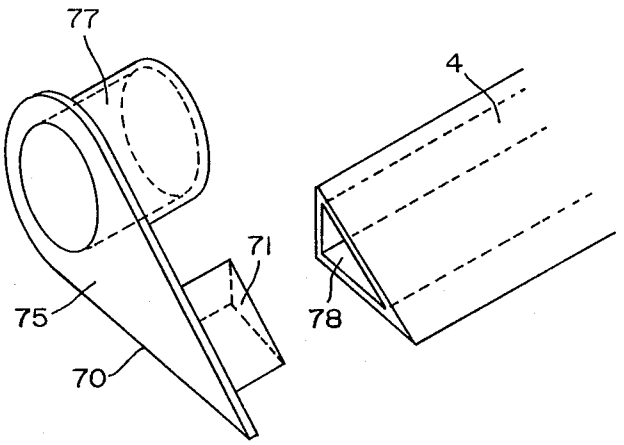

FIG. 7E shows an embodiment in some respects similar to the embodiments of FIGS. 4A, 4B. In this embodiment, an arm member 70 is provided as a separately molded end piece having an arm-like region 75, a bearing-like roll centering region 77, and an extension portion 71 for assembly to the blade 4. Member 70 is preferably formed of a somewhat soft molded plastic material, such as polypropylene. Extension 71 has dimensions slightly larger than the dimensions of a corresponding opening 78 in the blade member. Blade number 4 is preferably formed as an extrusion, from a hard, rigid material such as aluminum or a hard plastic. Member 70 is pressed into the blade member so as to be permanently affixed thereto. Adhesive may be applied before assembly of the blade and end piece 70.

It will be appreciated that the entire device is light in weight, and small in size, taking up little more space than a ruler. The blade member pendulously hangs from the roll of material, entirely avoiding the cumbersome frame elements of existing paper cutters, and allowing even large rolls of tracing paper to be manipulated at arbitrary orientations for tracing details of drawings.

The invention is advantageously constructed of molded plastic, or of extruded plastic or metal, components. Such construction permits the invention to be made at a small cost, so that it can be sold as a single-use disposable item. The trace cutter may be readily adapted with appropriate changes in dimensions for use with roll paper towels, and also for use with decorative gift wrapping paper. As a wrapping paper cutter, the small size and low cost of the cutter according to the invention allow improved economy and convenience. The invention enables a person to maintain at hand a large number of wrapping papers, each ready for use with its separate cutter.

The invention having been thus described, further modifications and variations will occur to those skilled in the art and all such modifications and variations are intended to be within the scope of the invention as limited only by the following claims.

What is claimed is:

1. Apparatus for cutting sheet material wound about an open-ended roll, such roll having the form of a cylindrical shell of length L with a roll axis, wherein the apparatus comprises:

a blade member of length L lying generally within a tapered profile and having a cutting edge extending from a first end to a second end of the blade member;

opposing first and second arms affixed to the blade member at respective first and second ends thereof;

positioning means affixed to each arm at an end thereof distal to the blade member for moving under the influence of gravity within the cylindrical shell when the roll is hand held so as to position the blade member parallel to the roll axis, wherein the arms hold the blade member such that the blade pendulously assumes said parallel position with its cutting edge oriented away from said roll, said cutting edge being radiused so as to define, when urged against a work table, a line of contact at said cutting edge for cutting said sheet material.

2. Apparatus according to claim 1, wherein each arm includes a pin extending from the said arm toward the opposing said arm, and wherein the positioning means includes a bearing mounted on the pin for bearing against the inner surface of the cylindrical shell.

3. Apparatus according to claim 2 wherein the bearing is a bushing.

4. Apparatus according to claim 3, wherein the bushing is of a diameter substantially less than an inner diameter of the cylindrical shell.

5. Apparatus according to claim 1, wherein one said arm is elastically movable in a direction away from the other said arm, so that a roll of material may be placed between the positioning means by elastically extending the one said arm a distance greater than L from the other said arm.

6. Apparatus according to claim 5, wherein a said arm includes a guide means slideably mounted in a recess in the blade member for elastically extending the arm a variable distance from the end of the blade member by sliding the guide in the recess.

7. Apparatus according to claim 1, wherein the positioning means includes a centering member protruding from a side of each arm toward the opposing arm.

8. Apparatus for cutting sheet material from a body of such material wound about a cylindrical shell roller, such apparatus comprising:

first and second arm means pendulously mounted for hanging from respective first and second ends of the cylindrical shell by freely bearing against an inner surface of the shell, and blade means affixed to said first and second arm means with a cutting edge oriented away from the roller and a aligned with respect to the arm such that the blade means hangs by the arm means parallel to the roller, said blade means lying generally within a tapered profile and said cutting edge being radiused such that when resting on a work table, said cutting edge and said work table form a line of contact for cutting said sheet material.

9. Apparatus according to claim 8, wherein each said arm means includes a pin extending therefrom toward the other said arm means, and further includes a bearing, mounted on the pin, for bearing against the inner surface of the cylindrical shell roller.

10. Apparatus according to claim 9, wherein the bearing is bushing.

11. Apparatus according to claim 10, wherein the bearing is of a diameter substantially less than the inner diameter of the cylindrical shell.

12. Apparatus according to claim 9, wherein a said bearing has an outer diameter greater than a thickness dimension of a said arm means.

13. Apparatus according to claim 9, wherein the pins of said first and second arm means lie on a common axis, and wherein the blade means includes a substantially linear cutting edge which, together with the common axis, determines a central plane of symmetry of the said blade means.

14. Apparatus according to claim 9, adapted for use with a cylindrical shell of thickness T, and wherein the apparatus includes a bearing having outer radius R, and also includes arm and blade means dimensioned such that the cutting edge of the blade is positioned by the arm means a distance A from the pin axis, wherein the cutting edge of the blade has an angle less than $$\frac{R+T}{A}.$$

15. Apparatus according to claim 9, further including spring positioning means for elastically positioning an arm means to permit insertion of a roller between said first and second arm means.

16. A device for cutting tracing paper from a roll of length L, such device comprising:

a blade of length L a holder affixed to the blade and extending from the blade to the roll, such holder having, at an end thereof distal with respect to the blade, alignment means in rolling contact with a surface of the roll for aligning the blade parallel to the roll, said blade lying generally within a tapered profile and having a cutting edge which is radiused such that when resting on a work table, said cutting edge and said work table form a line of contact for cutting paper from the roll by tearing the tracing paper up against the blade.

17. A device according to claim 16, wherein the holder includes a substantially cylindrical case having an inner surface for holding the roll therewithin, so that the roll is in rolling contact along its outer surface with the inner surface of the case.

18. A device according to claim 16, wherein the holder includes an arm extending from each end of the blade, and wherein each arm has mounted thereon a bearing for rolling against the interior of the roll.

19. A device according to claim 16, wherein the holder includes an arm extending generally perpendicularly away from each end of the blade to a distal arm end, and further includes a substantially cylindrical member extending from each said arm at its distal arm end for securing the roll therebetween.

20. A device according to claim 16, wherein the holder is permanently affixed to the blade member.

21. A device according to claim 16, wherein the holder is press-fit into non-destructively removable engagement with the blade member.

* * * * *